US005527156A

United States Patent [19]

Song

[11] Patent Number: 5,527,156

[45] Date of Patent: Jun. 18, 1996

[54] APPARATUS FOR AND METHOD OF CONTROLLING ENGINE AND PUMPS OF HYDRAULIC CONSTRUCTION EQUIPMENT

[75] Inventor: Myung-Hoon Song, Kyungki, Rep. of Korea

[73] Assignee: Samsung Heavy Industry Co., Ltd., Rep. of Korea

[21] Appl. No.: 334,217

[22] Filed: Nov. 4, 1994

[30] Foreign Application Priority Data

Dec. 30, 1993 [KR] Rep. of Korea ..... 93-31450

[51] Int. Cl.[6] ..... F04B 41/06

[52] U.S. Cl. ..... 417/2; 417/34; 417/53; 417/212; 417/213; 417/216; 60/449; 60/452

[58] Field of Search ..... 417/2, 34, 53, 417/212, 213, 216; 60/449, 452

[56] References Cited

U.S. PATENT DOCUMENTS

| | | | |
|---|---|---|---|
| 4,451,893 | 5/1984 | Izumi et al. | 417/20 |
| 4,637,781 | 1/1987 | Akiyama et al. | 417/216 |
| 4,672,811 | 6/1987 | Yoshida et al. | 60/449 |
| 4,773,369 | 9/1988 | Kobayashi et al. | 417/216 |
| 4,809,504 | 3/1989 | Izumi et al. | 60/449 |
| 4,846,046 | 7/1989 | Kanai et al. | 417/216 |
| 4,904,161 | 2/1990 | Kamide et al. | 417/34 |
| 5,129,230 | 7/1992 | Izumi et al. | 60/452 |
| 5,197,860 | 3/1993 | Nishida et al. | 417/34 |
| 5,226,800 | 7/1993 | Morino | 60/452 |
| 5,352,095 | 10/1994 | Tanaka et al. | 417/53 |

*Primary Examiner*—Richard A. Bertsch
*Assistant Examiner*—Xuan M. Thai
*Attorney, Agent, or Firm*—Lieberman & Nowak

[57] ABSTRACT

An apparatus for and a method of controlling the engine and pumps of hydraulic construction equipment capable of achieving automation of the hydraulic construction equipment by controlling the oil quantity fed to solenoid controlled proportional valves such that it is proportional to the manipulation amount of a manipulation command unit through a computation performed by a controller on the basis of engine RPM data from an engine RPM detection unit and pump delivery pressure variation data from a pump delivery pressure detection units so that the suction horse power of each of the pumps corresponds to the maximum output horse power of the engine and by controlling the oil quantity fed to the hydraulic cylinders 105*a* and 105*b* by oil quantity control valves such that it corresponds to the manipulation amount and manipulation ratio from the manipulation command unit.

5 Claims, 3 Drawing Sheets

APPARATUS FOR AND METHOD OF CONTROLLING ENGINE AND PUMPS OF HYDRAULIC CONSTRUCTION EQUIPMENT

BACKGROUND OF THE INVENTION

1. Field of the Invention

The present invention relates to hydraulic construction equipment such as excavators, loaders, bulldozers and the like, and more particularly to an apparatus for and a method of controlling the engine and pumps of such hydraulic construction equipment to achieve the automation of the hydraulic construction equipment.

2. Description of the Prior Art

As is well-known, hydraulic construction equipment includes a plurality of variable displacement pumps and work implements, such as booms, arms and buckets using a plurality of hydraulic cylinders as their actuators. Manipulation of such work implements is carried out by using manipulation command means such as joy stick, pedal and lever disposed near the driver's seat. On the other hand, the speed of each work implement and the speed ratio of the work implement to each other work implements associated therewith are proportional to the manipulation amount and manipulation ratio of the manipulation command means associated with the work implement. In order to satisfy the required speed of each work implement, each pump is designed to supply a quantity of operating oil proportional to the manipulation amount of the manipulation command means.

Actually, however, the pump has a mechanical limitation of maximum delivery oil quantity. Where the work implement is electronically controlled using an electric manipulation command device and a solenoid controlled proportional valve, the sum of required pump delivery quantities corresponding to respective command values of manipulation command means for work implements and to the respective speeds of the work implements may exceed the maximum delivery oil quantity under the current load pressure, depending on the variation in load pressure caused by a variation in working circumstance in excavating, loading and leveling type work.

In such a case, when the work implements operate in combination, the actual speed ratio of each work implement to each other work implements associated therewith can not correspond to the manipulation ratio based on a corresponding manipulation command signal for the work implement in accordance with known engine-pump control methods. In other words, the speed of each work implement and the speed ratio of the work implement to each associated work implement can not correspond to the manipulation amount and manipulation ratio based on the manipulation command signal due to variations in working circumstances and load pressures. This results in degradations of workability and working efficiency. Moreover, a stall phenomenon occurs in the engine due to an overload generated in the work process.

SUMMARY OF THE INVENTION

Therefore, an object of the present invention is to provide an apparatus for and a method of controlling an engine and pumps of hydraulic construction equipment, enabling a suction horse power of the pumps according to the manipulation amount and manipulation ratio based on a manipulation command signal for a work implement to optimally correspond to the maximum output horse power of the engine.

Another object of the present invention is to provide an apparatus for and a method of controlling an engine and pumps of hydraulic construction equipment, enabling the speed of each work implement and the speed ratio of the work implement to each other work implements associated therewith to correspond to the manipulation ratio based on a corresponding manipulation command signal for the work implement irrespective of variations in working circumstance and load pressure, thereby capable of improving workability and working efficiency.

Another object of the present invention is to provide an apparatus for and a method of controlling an engine and pumps of hydraulic construction equipment, capable of preventing a reduction in output due to a variation in working circumstance and a reduction in output due to a variation in condition of the engine by the lapse of time and capable of highly utilizing the output of the engine in a wide load range and thereby achieving an enhancement in workability per power.

In accordance with one aspect, the present invention provides hydraulic construction equipment using an engine as a power source, at least one variable displacement type hydraulic pump driven by the engine, at least one actuator for actuating a corresponding work implement, a solenoid controlled proportional oil quantity control valve disposed in an oil line connected between the hydraulic pump and the actuator and adapted to switch a connection of the oil line in accordance with a predetermined input signal and adjust the output oil quantity to be proportional to the input signal, and a solenoid controlled proportional valve adapted to adjust a delivery oil quantity of the hydraulic pump in accordance with a predetermined input signal, an apparatus for controlling the engine and the hydraulic pump, comprising: work implement manipulation command means adapted to receive a manipulation command signal for the work implement generated by the driver; engine RPM detection means adapted to detect the RPM of the engine; pump delivery oil quantity detection means adapted to detect a delivery oil quantity of the hydraulic pump; pump delivery pressure detection means adapted to detect a delivery pressure of the hydraulic pump; and control means adapted to control the solenoid controlled proportional valve on the basis of engine RPM data from the engine RPM detection means and pump delivery pressure variation data from the pump delivery pressure detection means such that the suction horse power of the hydraulic pump corresponds to the maximum output horse power of the engine and to control the oil quantity control valve such that the oil quantity to be fed to the actuator corresponds to the manipulation amount and the manipulation ratio based on the manipulation command signal from the manipulation command means.

BRIEF DESCRIPTION OF THE DRAWINGS

Other objects and aspects of the present invention will become apparent from the following description of embodiments with reference to the accompanying drawings in which.

DETAILED DESCRIPTION OF THE PREFERRED EMBODIMENTS

Figure 1:
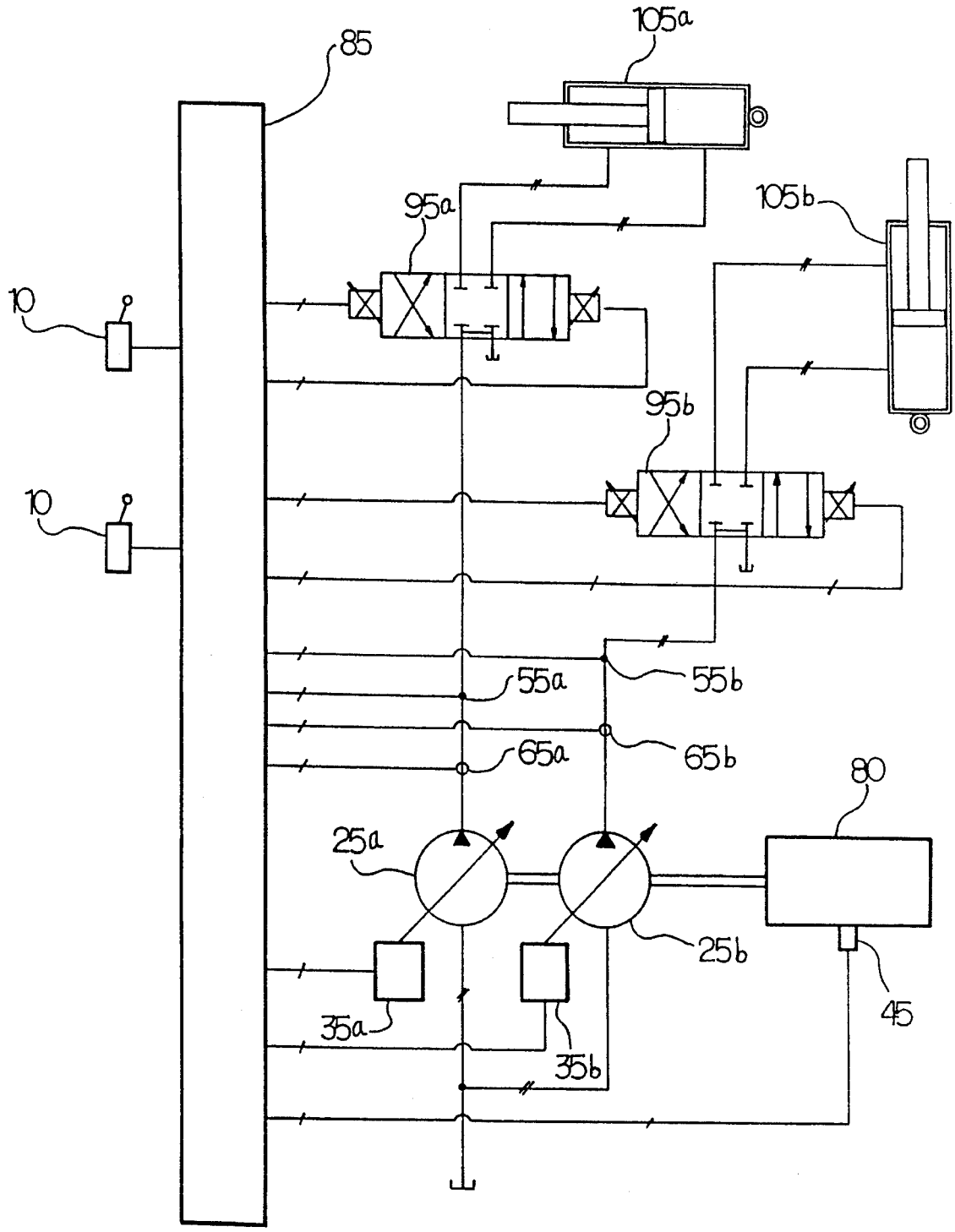
FIG. 1 is a circuit diagram Illustrating the overall system of a hydraulic excavator to which an engine-pump control apparatus in accordance with the present invention is applied.

FIG. 1 is a circuit diagram illustrating the overall system of an excavator to which an engine-pump control apparatus in accordance with the present invention is applied.

As shown in FIG. 1, the excavator includes an engine 80 as a power source, a pair of variable displacement type hydraulic pumps 25*a* and 25*b* driven by the engine 80, and a pair of hydraulic cylinders 105*a* and 105*b* as actuators respectively adapted to actuate corresponding work implements. A pair of solenoid controlled proportional oil quantity control valves 95*a* and 95*b* are disposed in oil lines connected between respective hydraulic pumps 25*a* and 25*b* and respective corresponding hydraulic cylinders 105*a* and 105*b*. Each of the oil quantity control valves 95*a* and 95*b* serves to switch connection of the corresponding oil line in accordance with a predetermined input signal and to adjust the delivery oil quantity to be proportional to the input signal. The excavator further includes a pair of solenoid controlled proportional valves 35*a* and 35*b* respectively adapted to adjust delivery oil quantities of the hydraulic pumps 25*a* and 25*b* in accordance with predetermined input signals.

The excavator also includes control means for electronically controlling the overall operation of the excavator. The control means comprises a manipulation command unit 10 for work implements, a controller 85 provided with a microcomputer, an engine RPM detection unit 45, a pair of pump delivery oil quantity detection units 55*a* and 55*b*, and a pair of pump delivery pressure detection units 65*a* and 65*b*.

Basically, the electronic-hydraulic system of the excavator is controlled to feed to the solenoid controlled proportional valves 35*a* and 35*b* the oil quantity proportional to the manipulation amount of the manipulation command unit 10 through a computation performed by the controller 85 on the basis of engine RPM data from the engine RPM detection unit 45 and pump delivery pressure variation data from the pump delivery pressure detection units 65*a* and 65*b* so that the suction horse power of each of the hydraulic pumps 25*a* and 25*b* corresponds to the maximum output horse power of the engine. The electronic-hydraulic system is also operated to control, by the oil quantity control valves 95*a* and 95*b*, the oil quantity fed to the hydraulic cylinders 105*a* and 105*b* such that it corresponds to the manipulation amount and manipulation ratio from the manipulation command unit 10.

Figure 2:
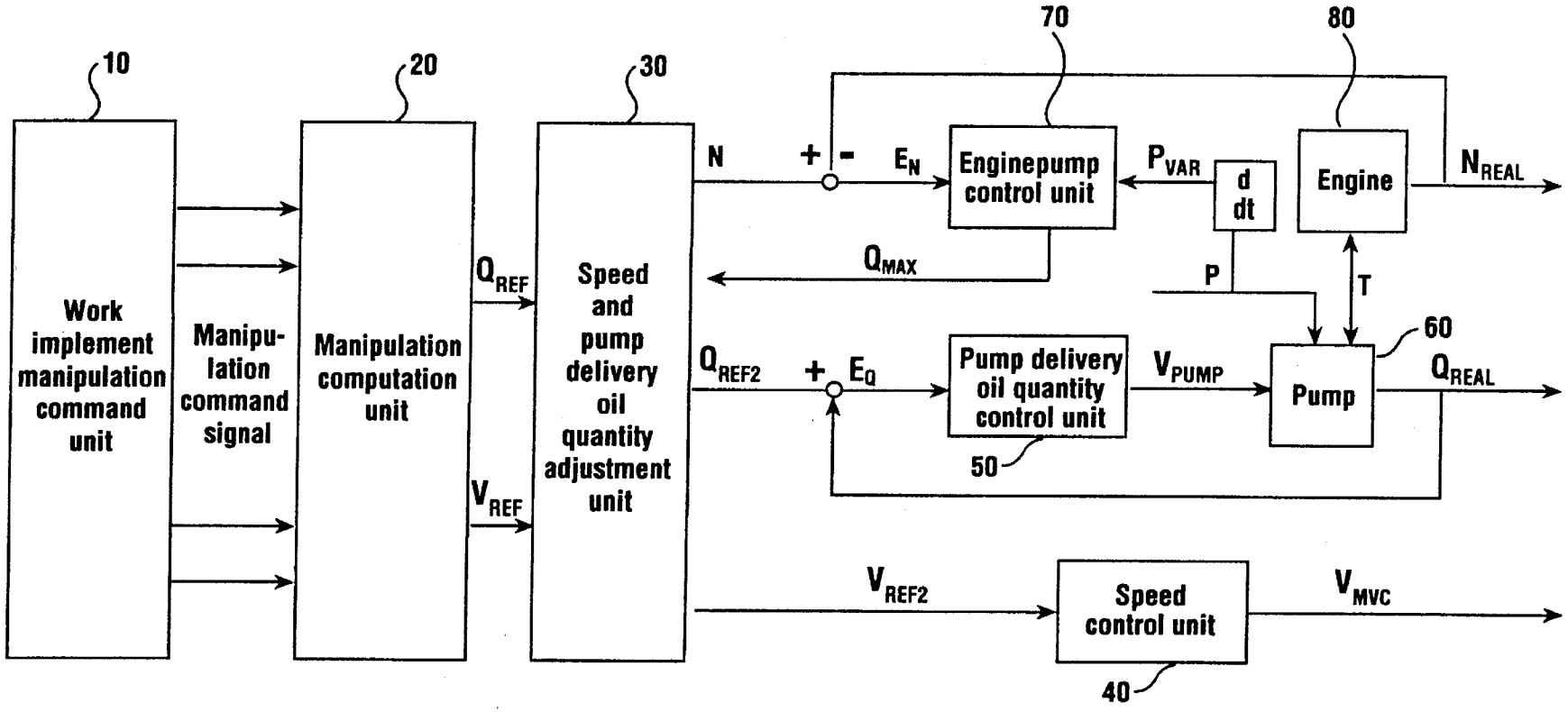
FIG. 2 is a block diagram of the engine-pump control apparatus employed in the excavator having the above-mentioned arrangement in accordance with the present invention.

FIG. 2 is a block diagram of the engine-pump control apparatus employed in the excavator having the above-mentioned arrangement in accordance with the present invention.

As shown In FIG. 2, the engine-pump control apparatus includes a manipulation computation unit 20 for sensing a manipulation command signal from the manipulation command unit 10 and computing a reference input signal QREF for pump delivery oil quantity control indicative of the required pump delivery oil quantity value proportional to the manipulation amount based on the sensed manipulation command signal and a reference input signal $V_{REF}$ for work implement speed control indicative of the required work implement speed value proportional to the manipulation amount and manipulation ratio based on the sensed manipulation command signal.

The engine-pump control apparatus also includes an engine-pump control unit 70 for generating a current maximum pump delivery oil quantity signal QMAX through a control computation using an error EN (NREF - NREAL) between a reference input signal NREF for Engine RPM control for obtaining the maximum horse power of the engine and a real engine RPM signal NREAL and on the basis of a pump delivery pressure variation signal PVAR. The current maximum pump delivery oil quantity signal QMAX from the engine-pump control unit 70 is sent to a speed and pump delivery oil quantity control unit 30.

On the basis of the reference input signal QREF from the manipulation computation unit 20 and the current maximum pump delivery oil quantity signal QMAX from the engine-pump control unit 70, the speed and pump oil delivery quantity adjustment unit 30 re-adjusts the reference input signal QREF and the reference input signal VREF. The resultant signal from the speed and pump oil delivery quantity adjustment unit 30 is sent to a work implement speed control unit 40 and a pump oil delivery quantity control unit 50.

The pump oil delivery quantity control unit 50 performs a controlled computation using an error EQ (QREF2 - QREAL) between the output signal from the speed and pump oil delivery quantity adjustment unit 30, namely, another reference input signal QREF2 for pump oil delivery quantity control and a real pump delivery oil quantity signal QREAL from the pump delivery oil quantity detection unit. By the controlled computation, the pump oil delivery quantity control unit 50 generates a pump oil delivery quantity control signal VPUMP which is, in turn, sent to an solenoid controlled proportional valve of a pump 60 so as to control the pump delivery oil quantity.

On the other hand, the work implement speed control unit 40 performs a controlled computation using the output signal from the speed and pump oil delivery quantity adjustment unit 30, namely, the reference input signal VREF2 for work implement speed control. By the controlled computation, the work implement speed control unit 40 generates a work implement speed control signal Vucv which is, in turn, sent to a solenoid controlled proportional valve of the engine-pump control unit 70 so as to control the speed of the work implement.

Operation of the engine-pump control unit 70 will now be described in detail, in conjunction with a flow chart shown in FIG. 3.

Figure 3:
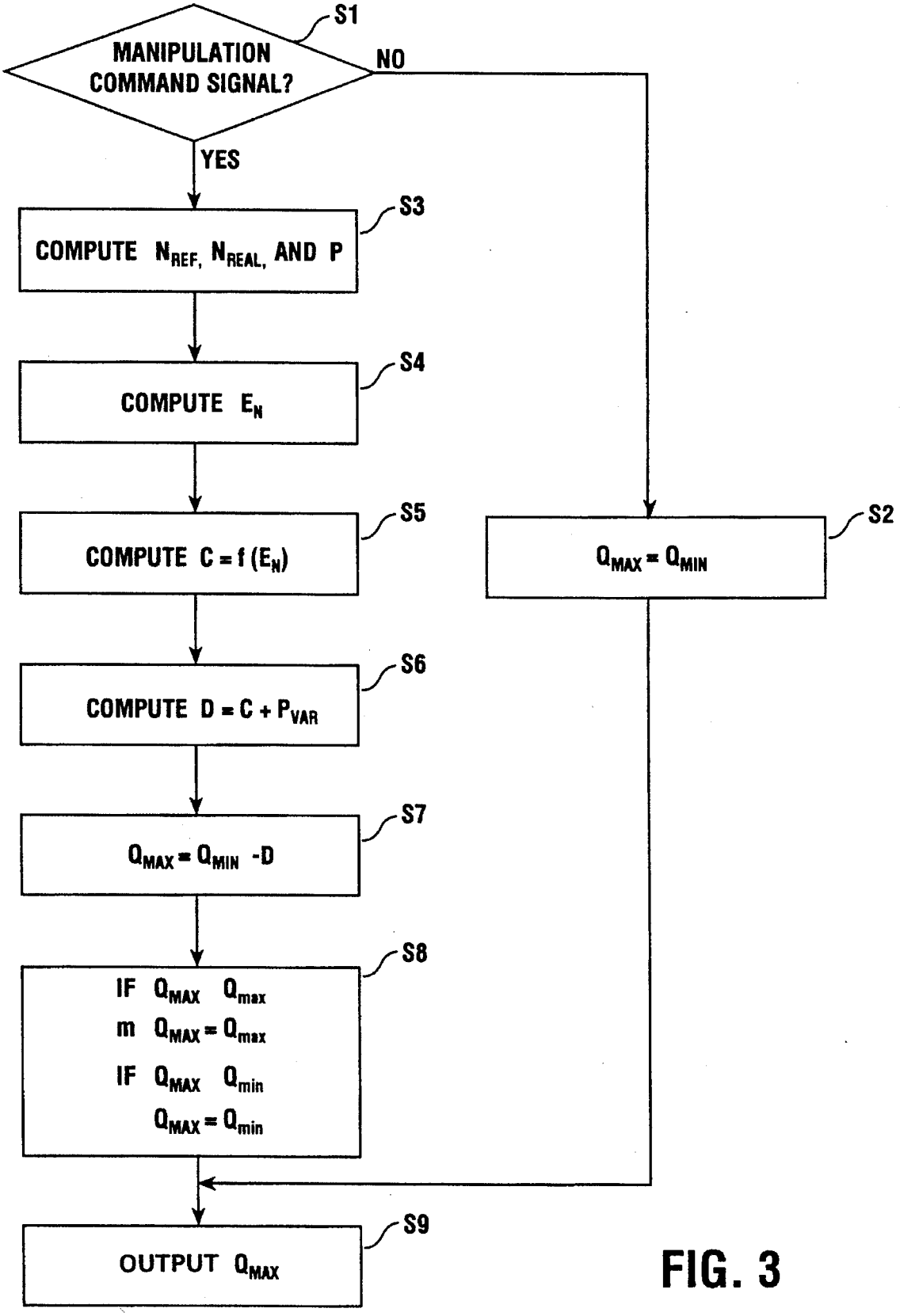
FIG. 3 is a flow chart illustrating a method for controlling engine and pump operations in the excavator as shown in FIG. 1 in accordance with the present invention.

At a first step S1 shown in FIG. 3, a discrimination is made about whether a manipulation command signal has been generated from the manipulation command unit 10. When it has been determined at step S1 that no manipulation command signal has been generated from the manipulation command unit 10, the procedure proceeds to a second step S2.

At the second step S2, the current maximum pump delivery oil quantity signal QMAX is set to be equal to a current minimum pump delivery oil quantity signal Qmin. In other words, the current maximum pump delivery oil quantity QuAx is determined as the current minimum pump delivery oil quantity Qmin mechanically deliverable by the pump.

On the other hand, where it has been determined at step S1 that the manipulation command signal has been generated from the manipulation command unit 10, the procedure proceeds to a third step S3. At the third step S3, inputting of a reference input signal NRFEF for engine RPM control, a real engine RPM signal NREAL and a pump delivery pressure P are executed. A computation of a pump delivery pressure variation signal PVAR is then executed on the basis of the input signals.

Thereafter, a fourth step S4 is executed to compute an error signal EN (NREF - NREAL) between the reference input signal NREF and the real engine RPM signal NREAL both input at the third step S3.

At a fifth step S5, a computation of a control signal C (C=f(EN)) is then executed using the error signal EN computed at the fourth step S4 and a control function f(x).

Subsequently, a sixth step S6 is executed to compute a control signal D (D=C+PVAR) by adjusting the control signal C computed at the fifth step S5 on the basis of the pump delivery pressure variation signal PVAR.

Using the control signal D computed at the sixth step S6, the current maximum pump delivery oil quantity QMAX (QMAX=Qmin–D) is then computed at a seventh step S7.

At an eighth step S8, a determination is made about whether the current maximum pump delivery oil quantity signal QMAX is not more than the current minimum pump delivery oil quantity signal Qmin mechanically deliverable by the pump. If the current maximum pump delivery oil quantity signal QMAX is not more than the current minimum pump delivery oil quantity signal Qmin, then it is determined as being indicative of the current minimum pump delivery oil quantity Qmin.

A determination is also made at the eight step S8 about whether the current maximum pump delivery oil quantity signal QMAX is not less than the current maximum pump delivery oil quantity signal Qmax mechanically deliverable by the pump. If the current maximum pump delivery oil quantity signal QMAX is not less than the current maximum pump delivery oil quantity signal Qmax, then it is determined as being indicative of the current maximum pump delivery oil quantity Qmax.

Thereafter, the current maximum pump delivery oil quantity signal QMAX computed at each of the steps S2 and S8 is then sent to the speed and pump delivery oil quantity adjustment unit 30. Then, the control procedure is completed.

By referring to the above description, the engine-pump control unit 70 determines the rate RPM at full throttle, namely, the maximum engine horse power point as the reference RPM when the manipulation command signal from the manipulation command unit 10 has been generated. When the engine is subjected to a load in process of working, the engine RPM is decreased while the pump delivery pressure variation signal PVAR and the torque are increased.

When the real engine RPM detected by the engine RPM detection unit 45 is less than the reference RPM, the current maximum pump delivery oil quantity is optimally decreased in order to decrease the suction horse power of the pump. This is achieved by controlled computations of the pump delivery pressure variation signal PVAR and the RPM error. The speed and pump oil delivery quantity adjustment unit 30 adjusts the reference input signal VREF for work implement speed control and the reference input signal QREF2 for pump delivery oil quantity control.

As apparent from the above description, the engine-pump control apparatus of the present invention, which is applied to construction equipment with work implement using a plurality of variable displacement pumps and a plurality of hydraulic cylinders as their actuators, prevents a stall phenomenon of the engine due to an overload generated in process of working, a reduction in output due to a variation in working circumstance and a reduction in output due to a variation in condition of the engine by the lapse of time.

The engine-pump control apparatus of the present invention also utilizes the output of the engine highly in a wide load range, thereby achieving an enhancement in workability per power.

The work can be automated in accordance with the present invention because the speed of each work implement and the speed ratio of the work implement to each other working members associated therewith are optimally controlled to correspond to the manipulation amount and manipulation ratio based on the manipulation command signal irrespective of the variations in working circumstance and load pressure. Furthermore, improvements In workability and working efficiency are obtained.

Although the preferred embodiments of the present invention have been disclosed for illustrative purposes, those skilled in the art will appreciate that various modifications, additions and substitutions are possible, without departing from the scope and spirit of the present invention as disclosed In the accompanying claims.

What is claimed is:

1. In a hydraulic construction equipment including an engine as a power source, at least one variable displacement type hydraulic pump driven by the engine, at least one actuator for actuating a corresponding work implement, a solenoid controlled proportional oil quantity control valve disposed in an oil line connected between the hydraulic pump and the actuator and adapted to switch a connection of the oil line in accordance with a predetermined input signal and adjust an output oil quantity to be proportional to the input signal, and a solenoid controlled proportional valve adapted to adjust a delivery oil quantity of the hydraulic pump in accordance with a predetermined input signal, an apparatus for controlling the engine and the hydraulic pump, comprising:

work implement manipulation command means adapted to receive a manipulation command signal for the working member generated by a driver;

engine RPM detection means adapted to detect an RPM of the engine;

pump delivery oil quantity detection means adapted to detect a delivery oil quantity of the hydraulic pump;

pump delivery pressure detection means adapted to detect a delivery pressure of the hydraulic pump; and control means adapted to control the solenoid controlled proportional valve on the basis of engine RPM data from the engine RPM detection means and pump delivery pressure variation data from the pump delivery pressure detection means such that a suction horse power of the hydraulic pump corresponds to a maximum output horse power of the engine and to control the oil quantity control valve such that a oil quantity to be fed to the actuator corresponds to a manipulation amount and a manipulation ratio based on the manipulation command signal from the manipulation command means.

2. The apparatus in accordance with claim 1, wherein the control means comprises:

a manipulation computation unit for computing a required pump delivery oil quantity value proportional to the manipulation amount from the manipulation command means and a required work implement speed value proportional to the manipulation amount and manipulation ratio from the manipulation command means;

an engine-pump control unit for generating a current maximum pump delivery oil quantity signal through a controlled computation using an error between a reference input signal for an engine RPM control for obtaining the maximum output horse power of the engine and a real engine RPM signal detected by the engine RPM detection means and on the basis of the pump delivery pressure variation signal detected by the pump delivery pressure detection means;

a work implement speed and pump delivery oil quantity control unit for re-adjusting the required pump delivery oil quantity value and the required work implement speed value obtained in the manipulation computation unit on the basis of the current maximum pump delivery oil quantity signal obtained in the engine-pump control unit:

a pump oil delivery quantity control unit for generating a pump delivery oil quantity control signal through a controlled computation using an error between the required pump delivery oil quantity value re-adjusted in the work implement speed and pump delivery oil quantity control unit and the real pump delivery oil quantity signal detected by the pump delivery oil quantity detection unit and sending the generated pump delivery oil quantity control signal to the solenoid controlled proportional valve to control the delivery oil quantity of the hydraulic pump; and a work implement speed control unit for generating a work implement speed requirement signal through a controlled computation using the required work implement speed value readjusted in the work implement speed and pump delivery oil quantity control unit and sending the generated work implement speed requirement signal to the oil quantity control valve to control the speed of the work implement.

3. A method for controlling engine and pump operations in a hydraulic construction equipment including an engine as a power source, at least one variable displacement type hydraulic pump driven by the engine, at least one actuator for actuating a corresponding work implement, a solenoid controlled proportional oil quantity control valve disposed in an oil line connected between the hydraulic pump and the actuator and adapted to switch a connection of the oil line in accordance with a predetermined input signal and adjust an output oil quantity to be proportional to the input signal, a solenoid controlled proportional valve adapted to adjust a delivery oil quantity of the hydraulic pump in accordance with a predetermined input signal, work implement manipulation command means adapted to receive a manipulation command signal for the work implement generated by a driver, engine RPM detection means adapted to detect an RPM of the engine, pump delivery oil quantity detection means adapted to detect a delivery oil quantity of the hydraulic pump, and pump delivery pressure detection means adapted to detect a delivery pressure of the hydraulic pump, comprising the step of:

controlling the solenoid controlled proportional valve on the basis of engine RPM data from the engine RPM detection means and pump delivery pressure variation data from the pump delivery pressure detection means such that a suction horse power of the hydraulic pump corresponds to a maximum output horse power of the engine and controlling the oil quantity control valve such that an oil quantity to be fed to the actuator corresponds to a manipulation amount and a manipulation ratio based on the manipulation command signal from the manipulation command means.

4. The method in accordance with claim 3, wherein the control step comprises:

the first step of computing a required pump delivery oil quantity value proportional to the manipulation amount from the manipulation command means and a required work implement speed value proportional to the manipulation amount and manipulation ratio from the manipulation command means;

the second step of generating a current maximum pump delivery oil quantity signal through a controlled computation using an error between a reference input signal for an engine RPM control for obtaining the maximum output horse power of the engine and a real engine RPM signal detected by the engine RPM detection means and on the basis of the pump delivery pressure variation signal detected by the pump delivery pressure detection means;

the third step of re-adjusting the required pump delivery oil quantity value and the required work implement speed value obtained at the first step on the basis of the current maximum pump delivery oil quantity signal obtained at the second step;

the fourth step of generating a pump delivery oil quantity control signal through a controlled computation using an error between the required pump delivery oil quantity value readjusted at the third step and the real pump delivery oil quantity signal detected by the pump delivery oil quantity detection unit, sending the generated pump delivery oil quantity control signal to the solenoid controlled proportional valve, and thereby controlling the delivery oil quantity of the hydraulic pump; and the fifth step of generating a work implement speed requirement signal through a controlled computation using the required work implement speed value re-adjusted at the third step, sending the generated work implement speed requirement signal to the oil quantity control valve, and thereby controlling the speed of the work implement.

5. The method in accordance with claim 4, wherein the second step comprises the steps of:

(a) discriminating whether the manipulation command signal has been output from the manipulation command unit;

(b) determining a current maximum pump delivery oil quantity as a current maximum pump delivery oil quantity mechanically deliverable by the hydraulic pump when it has been determined at step (a) that no manipulation command signal has been generated from the manipulation command unit;

(c) executing inputting of a reference input signal for an engine RPM control, a real engine RPM signal and a pump delivery pressure when it has been determined at step (a) that the manipulation command signal has been generated from the manipulation command unit, and then computing a pump delivery pressure variation signal on the basis of the input signals;

(d) computing an error signal between the reference input signal for the engine RPM control and the real engine RPM signal both input at the step (c);

(e) computing a control signal using the error signal computed at the step (d) and a control function;

(f) adjusting the control signal computed at the step (e) on the basis of the pump delivery pressure variation signal;

(g) computing the current maximum pump delivery oil quantity using the control signal adjusted at step (f);

(h) determining the current maximum pump delivery oil quantity computed at step (g) as a minimum pump delivery oil quantity mechanically deliverable by the pump when the current maximum pump delivery oil quantity is not more than the current minimum pump delivery oil quantity, while determining the current maximum pump delivery oil quantity as a maximum pump delivery oil quantity mechanically deliverable by the pump when the current maximum pump delivery oil quantity signal is not less than the current maximum pump delivery otl quantity; and (i) outputting the current maximum pump delivery oil quantity determined at each of steps (b) and (h).

* * * * *